United States Patent [19]

Evans

[11] 3,940,291

[45] Feb. 24, 1976

[54] INSULATIVE COATINGS FOR ELECTRICAL STEELS

[75] Inventor: James D. Evans, Middletown, Ohio

[73] Assignee: Armco Steel Corporation, Middletown, Ohio

[22] Filed: Mar. 25, 1974

[21] Appl. No.: 454,074

Related U.S. Application Data

[60] Division of Ser. No. 237,344, March 23, 1972, Pat. No. 3,840,378, which is a continuation-in-part of Ser. No. 39,649, May 22, 1970, abandoned.

[52] U.S. Cl. ..... 148/6.15 R; 148/113; 148/27; 148/31.55

[51] Int. Cl.[2] ..... C23F 7/10

[58] Field of Search ..... 148/6.15 R, 6.15 Z, 31.55, 148/113, 27; 106/14

[56] References Cited

UNITED STATES PATENTS

| | | | |
|---|---|---|---|
| 2,501,846 | 3/1950 | Gifford | 148/6.15 R |
| 3,104,993 | 9/1963 | Sievert | 148/6.15 R |
| 3,207,636 | 9/1965 | Wada et al. | 148/113 |
| 3,450,578 | 6/1969 | Siemund et al. | 148/6.15 R |
| 3,522,113 | 7/1970 | Kohler | 148/6.15 R |
| 3,615,918 | 10/1971 | Evans et al. | 148/6.15 R |

*Primary Examiner*—Ralph S. Kendall
*Assistant Examiner*—Charles R. Wolfe, Jr.
*Attorney, Agent, or Firm*—Melville, Strasser, Foster & Hoffman

[57] ABSTRACT

Insulative coatings for electrical steels having improved resistance to deterioration during stress relief anneals or other heat treatments carried on in reducing atmospheres. They may be produced by coating electrical steel with an aqueous solution of phosphoric acid, magnesium oxide and one or more additional mineral acids present in an amount sufficient to adjust the pH level of the solution to from about 0.5 to about 3.0. The mole ratio $Mg/PO_4$ should be from about 0.6 to about 1.5.

12 Claims, 2 Drawing Figures

INSULATIVE COATINGS FOR ELECTRICAL STEELS

CROSS REFERENCE TO RELATED APPLICATION

This is a division of copending application Ser. No. 237,344 filed Mar. 23, 1972, now U.S. Pat. No. 3840378, in the name of the same inventor and entitled INSULATIVE COATINGS FOR ELECTRICAL STEELS which, in turn, is a continuation-in-part of the copending application of the same inventor, Ser. No. 39,649 filed May 22, 1970 and entitled INSULATIVE COATINGS FOR ELECTRICAL STEELS (now abandoned).

BACKGROUND OF THE INVENTION

1. Field of the Invention

The invention relates to improved insulative coatings for electrical steels, and more particularly to phosphate based insulative coatings resistant to deterioration during heat treatments in reducing atmospheres.

2. Description of the Prior Art

As used herein and in the claims the terms "electrical steel" or "silicon steel" relates to an alloy the typical composition of which by weight percent falls within the following:

| | |
|---|---|
| Carbon | 0.060% maximum |
| Silicon | 2 – 4% |
| Sulfur or Selenium | 0.03% maximum |
| Manganese | 0.02 – 0.4% |
| Aluminum | 0.04% maximum |
| Iron | balance |

At the present time, there is a great demand for silicon steels of sheet gauge for magnetic uses such as laminated cores for transformers and the like.

Magnetic cores, such as are used in power transformers and the like, require high interlamination resistivity. Much work has been done in this field to provide surface resistivity on electrical steels.

In the production of certain oriented grades of silicon steel a mill glass is formed during the high temperature anneal. Much work has been done toward the improvement of the insulative qualities of mill glass, as is exemplified in U.S. Pat. No. 2,385,332.

In some applications it is desirable to have an applied insulative coating rather than or in addition to the mill glass formed during the high temperature anneal. The need for an insulative coating which may be applied by the steel producer, so that the manufacturer may begin with sheets or coils having high surface resistivity, has led to the development of phosphate coatings. U.S. Pat. No. 2,501,846 and 2,492,095 are exemplary of such coatings. These phosphate coatings have been used with great success.

However, the manufacturer of electrical instrumentalities from silicon steel often requires that the silicon steel be subjected to a stress relief anneal or other heat treatment. Such stress relief anneals are frequently carried out at temperatures of from about 1450°F. to about 1600°F. (788°C. to 871°C.) in reducing atmospheres such as dry atmospheres containing 95% nitrogen and 5% hydrogen. Prior art phosphate coatings will demonstrate severe deterioration with respect to surface resistivity at temperatures as low as 1200°F. (649°C.) when the annealing atmosphere contains more than 2% hydrogen.

The present invention is based upon the discovery that phosphate based insulative coatings for electrical steels, with or without a mill glass base coating, will resist deterioration in reducing atmospheres if a mole ratio $Mg/PO_4$ is maintained at from about 0.6 to about 1.5 and preferably from about 0.7 to about 1.3. The coatings of the present invention include one or more additional mineral acids so as to maintain the pH level in the range of from 0.5 to 3.0 and preferably from about 1 to about 2 for the final solution.

SUMMARY OF THE INVENTION

The present invention contemplates the provision of improved insulative coatings for oriented electrical steels with or without a mill glass base coating through the application of aqueous solutions of phosphoric acid, magnesium oxide and one or more additional mineral acids such as sulfuric or nitric acids.

In accordance with the present invention, the mole ratio $Mg/PO_4$ is maintained in the range of from about 0.6 to about 1.5 and preferably from about 0.7 to about 1.3. The mineral acid is added to the mixture until the pH level is adjusted to the range of from about 0.5 to about 3.0, and preferably from about 1 to about 2.

In the above mentioned procedure, the mineral acids may be replaced by the magnesium salts thereof, provided that an adjustment is made in the magnesia addition to preserve the critical ratio.

The coating solutions of the present invention may be applied to the silicon steel (with or without a mill glass base coating) in any suitable and conventional manner. The coated silicon steel will be subjected to a heat treatment so that the final coating of the present invention will be formed thereon. This heat treatment is not to be confused with the final high temperature anneal given to silicon steel to develop grain orientation. Such a high temperature anneal would occur prior to the application of the coatings of the present invention.

DESCRIPTION OF THE PREFERRED EMBODIMENTS

Figure 1:
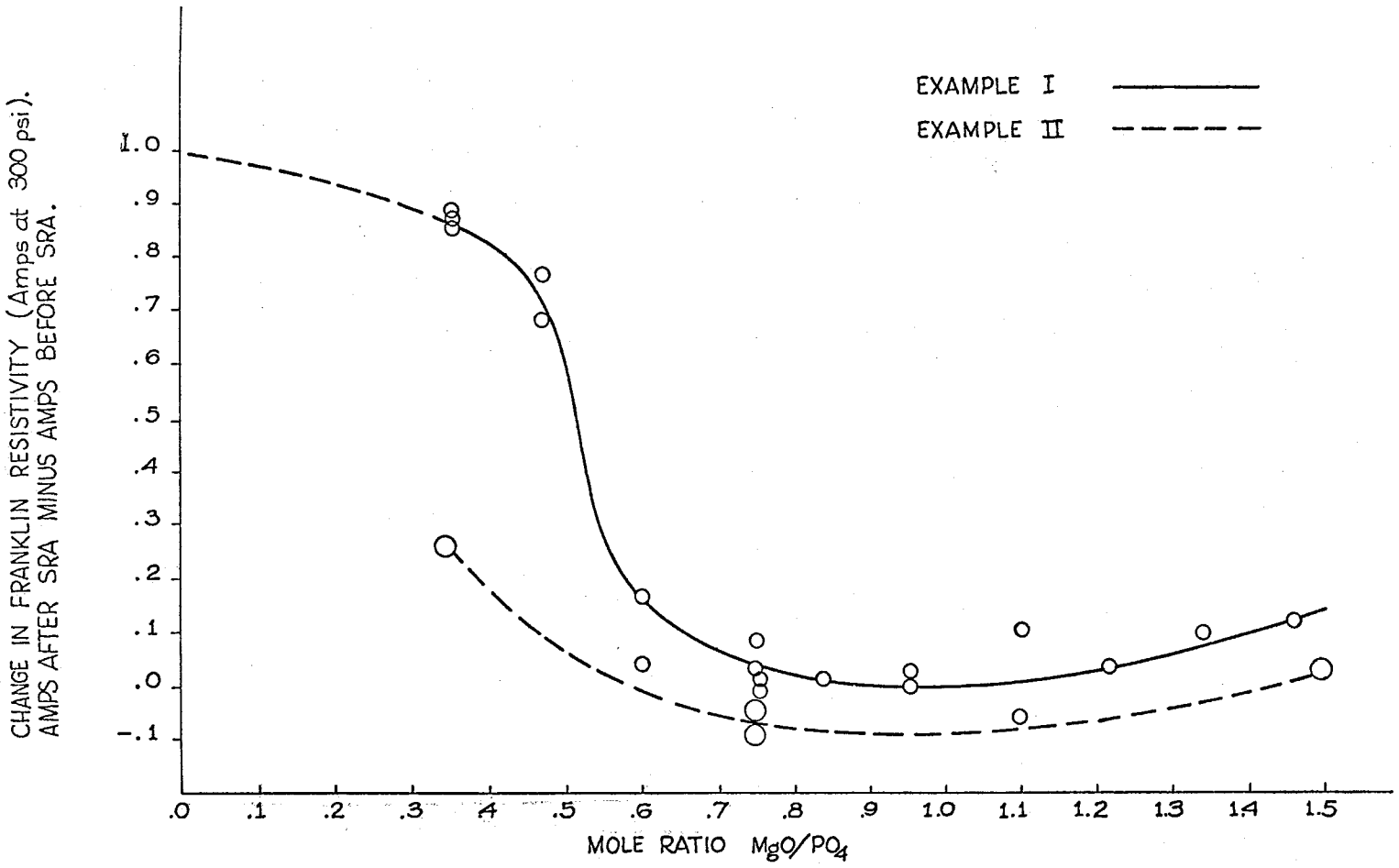
FIGS. 1 and 2 comprise graphs plotting the change in resistivity during stress relief annealing against the molar ratio $Mg/PO_4$ in the coating solution.

The coatings of the present invention are particularly suitable for use with oriented silicon steels of the cube-on-edge variety, but may be used with silicon steels of other orientations. When used with cube-on-edge oriented silicon steels, the coatings may be applied either on the bare metal (the mill glass base coating having been removed), or over a mill glass which formed during the high temperature anneal. In the practice of the present invention the coating solution should have a mole ratio $Mg/PO_4$ in the range of from about 0.6 to about 1.5 and preferably in the range of from about 0.7 to about 1.3. The pH level of the final solution should fall within the range of from about 0.5 to about 3.0 and preferably within the range of from about 1 to about 2.

When in the prior art, as exemplified by the above mentioned U.S. Pat. No. 2,501,846, magnesia was added to an aqueous solution of phosphoric acid in quantities to be wholly dissolved by the acid, a solution resulted having a pH of approximately 3 or less and a $Mg^{++}$ to $PO_4^{---}$ mole ratio of about .5 or less. This is true because about .455 (or, in round numbers, about .5) is the theoretical maximum mole ratio achievable in such a solution. If, to obtain a higher mole ratio, one were simply to add more magnesia, the mole ratio of the system would go up but the mole ratio of the solution would not. While the pH of the solution would go up, the mole ratio would not due to formation of Mg H $PO_4$ which is insoluble in water when the pH is above about 4 or 5.

There are two primary ways in which the mole ratio and pH values required by the present invention may be achieved. First, to an aqueous solution of magnesia and phosphoric acid and additional quantity of magnesia may be added together with one or more mineral acids such as sulfuric acid or nitric acid. The mineral acids are preferably volatile at a relatively low temperature.

The mole ratio $Mg/PO_4$ should be maintained in the range of from about 0.6 to about 1.5 and preferably in the range of from about 0.7 to about 1.3.

The mineral acid or acids are added until the pH level of the final solution falls within the range of about 0.5 to about 3.0 and preferably from about 1 to about 2. The purpose of adding the mineral acid is primarily to provide sufficient acidity to dissolve the metal phosphate. Variation of the acid content of the coating solutions of the present invention can be obtained by adding more or less mineral acid. Halogen acids, such as hydrochloric, may be used on bare steel but they are not recommended where a glass coating has previously been formed because they attack the glass and prevent the applied coating from having good adherence and good resistivity.

A second way of achieving the desired mole ratio and pH values of the present invention entails the addition to the aqueous solution of magnesia and phosphoric acid of a magnesium salt of a mineral acid such as sulfuric acid or nitric acid. This is substantially the equivalent of adding magnesia and the mineral acid as in the first instance. This is true because when, for example, magnesia and nitric acid are combined magnesium nitrate (the mangesium salt of nitric acid) is formed together with water. The formation of water is not important (there being water already in the system) except with respect to the desired concentration of the final solution as dictated by the desired coating weight and coating method. When this second method is used the pH of the solution will remain substantially unchanged and will fall within the desired range. It will be understood that the addition of a mineral acid salt other than a magnesium salt would be extraneous to the system and would not make the required $Mg^{++}$ addition to achieve the desired mole ratio value.

The coating solutions of the present invention may be mixed and applied by the same procedures heretofore practiced with respect to prior art phosphate coatings. For example, excellent results were achieved when the solutions were mixed in the following manner. A magnesia slurry (magnesia in distilled water) was slowly added to the equivalent of 75% phosphoric acid until a precipitate appeared. Then a mineral acid, such as sulfuric or nitric acid, was added to dissolve the precipitate. Thereafter, more slurry was again added. This procedure was continued until all of the magnesia slurry had been added and enough mineral acid had been added to dissolve any precipitate which had formed.

The coating solutions of the present invention may be as dilute as desired for controlled application to the surfaces of the silicon steel sheet or strip. The solutions may be applied in any suitable manner including spraying, dipping or swabbing. Metering rollers and doctor means may also be used. It has been determined that concentrated solutions, containing less than 40 percent of the total solution weight as water, tend to produce powdery coatings and are not easily applied by grooved wringer rolls. The upper limit of the percentage of the total solution weight as water is dictated only by the desired coating weight and the coating method used and can readily be ascertained by one skilled in the art to meet his particular needs.

It will be understood by one skilled in the art that prior to the application of the solutions, the silicon steel sheets or strips should be mechanically or chemically cleaned, so as to be free of oils, greases and scale. After coating, the silicon steel sheets or strips are dried and then subjected to a heat treatment in order to produce the final insulative coating. This heat treatment can be conducted at a temperature of from about 800°F. to about 1600°F. (427°C. to 871°C.) for from about ½ minute to about 5 minutes in a dry non-oxidizing atmosphere, or at a temperature of from about 1200°F. to about 1600°F. (649°C. to 871°C.) in air, if the coating is applied over a mill glass. The drying may be performed in a separate step or it may occur during the preliminary heating portion of the heat treatment just described.

Analyses of the final fired coatings of the present invention reveal the presence of magnesium orthophosphate, which is very stable, insoluble and resistant to hydrogen reduction. Other forms of magnesium phosphate and other compounds may be formed, depending upon the mineral acids added.

EXAMPLE I

Nineteens samples of 9 mil thick cube-on-edge oriented silicon steel having a mill glass base coating were cleaned to remove any oils, greases or scale. Thereafter, the samples had applied thereto coatings having a ratio $Mg/PO_4$ ranging from 0.35 to 1.45. The coating solution compositions are given in Table I.

TABLE I

| Coating Compositions as % of Total Solution Weight | | | | | | |
|---|---|---|---|---|---|---|
| Sample Number | MgO | $H_3PO_4$ | $HNO_3$ | $H_2SO_4$ | $H_2O$ | Mole Ratio $Mg/PO_4$ |
| 1,2,3 | 6.5 | 43.0 | — | — | 50.5 | .3 |
| 4 | 7.6 | 37.9 | — | — | 54.5 | .5 |
| 5 | 7.2 | 35.8 | 4.0 | — | 53.0 | .5 |
| 6 | 8.0 | 32.0 | 4.0 | — | 56.0 | .6 |
| 7 | 8.1 | 32.3 | — | 4.1 | 55.5 | .6 |
| 8 | 8.3 | 27.2 | 7.4 | — | 57.1 | .7 |
| 9 | 7.9 | 26.2 | 11.8 | — | 54.1 | .7 |
| 10 | 6.7 | 22.0 | — | 5.5 | 65.8 | .7 |
| 11 | 8.1 | 26.5 | 9.0 | — | 56.4 | .7 |
| 12 | 8.5 | 24.0 | 9.7 | — | 57.8 | .8 |
| 13 | 8.7 | 21.8 | 12.0 | — | 57.5 | 1.0 |
| 14 | 8.0 | 20.1 | 19.6 | — | 52.3 | 1.0 |
| 15 | 6.9 | 15.2 | — | 8.4 | 69.5 | 1.1 |
| 16 | 7.3 | 16.1 | 13.1 | — | 63.5 | 1.1 |
| 17 | 9.0 | 17.8 | 13.8 | — | 59.4 | 1.2 |
| 18 | 9.1 | 16.6 | 15.1 | — | 59.2 | 1.3 |
| 19 | 8.5 | 14.1 | 21.0 | — | 56.4 | 1.4 |

For all solutions the MgO slurry (MgO in water) was slowly added to the equivalent of 75% $H_3PO_4$ until a precipitate appeared; then $H_2SO_4$ or $HNO_3$ was added to dissolve the precipitate and more slurry was again added. This type of addition was continued until all the MgO has been added and enough mineral acid has been added to dissolve any precipitate which had formed.

The pH values determined for 11 of the solutions of Table I varied between 0.9 and 2.1. The pH values of the remaining solutions would be expected to fall within this range.

The strips were coated by immersing them in the solutions and passing them through wringer rolls having 43 grooves per inch 1-2 mil deep. The coated strips were predried 1 to 2 minutes in air at 600°F. (316°C.) and after coiling were fired in air at 1450°F. (788°C.) for 1 minute.

Franklin resistivity tests were made after shearing into Epstein samples and again after a stress relief anneal at 1450°F. (788°C.) in an atmosphere comprising 95% nitrogen and 5% hydrogen with a two hour soak. The test results are given in Table II below.

TABLE II

RESISTIVITY TESTS OF SAMPLES OF TABLE I

| Sample Number | Mole Ratio $Mg/PO_4$ | Ave. Franklin Resistivity (Amps at 300 psi) Before SRA | After SRA | Change |
|---|---|---|---|---|
| 1 | .3 | .019 | .89 | .87 |
| 2 | .3 | .025 | .87 | .85 |
| 3 | .3 | .012 | .85 | .84 |
| 4 | .5 | .075 | .82 | .75 |
| 5 | .5 | .035 | .70 | .67 |
| 6 | .6 | .055 | .215 | .160 |
| 7 | .6 | .066 | .103 | .037 |
| 8 | .7 | .064 | .082 | .018 |
| 9 | .7 | .096 | .174 | .078 |
| 10 | .7 | .036 | .022 | −.014 |
| 11 | .7 | .048 | .064 | .016 |
| 12 | .8 | .052 | .063 | .011 |
| 13 | 1.0 | .062 | .073 | .011 |
| 14 | 1.0 | .161 | .200 | .039 |
| 15 | 1.1 | .025 | .104 | .079 |
| 16 | 1.1 | .165 | .102 | −.063 |
| 17 | 1.2 | .069 | .091 | .022 |
| 18 | 1.3 | .058 | .151 | .093 |
| 19 | 1.4 | .144 | .264 | .120 |

In FIG. 1, the solid line shows the correlation between the change in resistivity during the stress relief anneal and the molar ratio of Mg to $PO_4$ in the coating solution. From FIG. 1 it will be evident that if the molar ratio is kept within the ranges given above, the change in resistivity is small. Samples 1 through 5 are exemplary of prior art coatings as taught in the above mentioned U.S. Pat. No. 2,501,846.

EXAMPLE II

Four samples were taken from each of five different 11 mil thick coils of cube-on-edge oriented silicon steel. The samples, numbered 20 through 23, were hard pickled to remove the mill glass base coating on the silicon steel.

Four coating solutions were made up having the compositions given in Table III below.

TABLE III

| Sample Number | Coating Solution | Mole Ratio $MgO/PO_4$ | Composition of Solution |
|---|---|---|---|
| 20,24 | A | .3 | 1120cc $H_2O$, 880 cc 85% $H_3PO_4$, 180 gm MgO |
| 21,25 | B | .7 | 1500cc $H_2O$, 415 cc 85% $H_3PO_4$, 80cc $H_2SO_4$ conc., 180 gm MgO |
| 22,26 | C | .7 | 1150cc $H_2o$, 415 cc 85% $H_3PO_4$, 200cc $HNO_3$ conc., 180 gm MgO |
| 23,27 | D | 1.5 | 965cc $H_2O$, 210cc 85% $H_3PO_4$, 365 cc $HNO_3$ conc., 180 gm MgO |

The samples were coated with the solutions at room temperature, dried at 600°F. (316°C.) for 60 to 90 seconds in air and cooled to room temperature.

Firing of the coatings was carried out in the strip furnace using a dry nitrogen atmosphere and a Bunsen burner flame curtain to protect the entrance end of the furnace. The samples were fired at 1500°F. (816°C.) for 1 to 1½ minutes. One-fourth inch was sheared from each edge of the samples to remove heavy coating.

Franklin resistivity measurements at 300 psi were taken at four positions on each sample both "as cut" and after a stress relief anneal at 1450°F. (788°C.) for 2 hours in a dry 95% nitrogen – 5% hydrogen atmosphere. The test results are given in Table IV below. Again, coating solution A is exemplary of those taught in U.S. Pat. No. 2,501,846.

TABLE IV

RESISTIVITY TESTS OF SAMPLES OF TABLE III

| Sample Number | Mole Ratio $Mg/PO_4$ | Ave. Franklin Resistivity (Amps at 300 psi) Before SRA | After SRA | Change |
|---|---|---|---|---|
| 20 | .3 | .14 | .38 | .24 |
| 21 | .7 | .14 | .11 | −.03 |
| 22 | .7 | .28 | .18 | −.10 |
| 23 | 1.5 | .44 | .46 | .02 |

The results are graphically illustrated by the broken line in FIG. 1. It will be noted that the coatings having a mole ratio of $Mg/PO_4$ within the ranges given above prevented a loss of resistivity during the stress relief anneal.

The results follow the general shape of the solid line of Example I, but are displaced downwardly. This displacement is thought to be due to the poorer "as cut" resistivity of the starting material (i.e. poorer as cut resistivity leaves more room for improvement during the stress relief anneal, thus giving a negative change in FIG. 1).

EXAMPLE III

Samples were taken from another 11 mil thick coil of cube-on-edge oriented silicon steel. Again the samples were hard pickled to remove the mill glass base coating therefrom.

The samples, numbered 24 through 29, were coated, dried and fired in the same manner as described in Example II. Samples 24 through 27 were provided with the same four coatings of Example II. Samples 28 and 29 were provided with two additional coatings having compositions given in Table V below.

TABLE V

| Sample Number | Coating Solution | Mole Ratio $Mg/PO_4$ | Composition of Solution |
|---|---|---|---|
| 28 | E | .5 | 1130cc $H_2O$, 625cc 85% $H_3PO_4$ conc., 180 gm MgO |
| 29 | F | .5 | 1130cc $H_2O$, 625 cc 85% $H_3PO_4$, 50cc $HNO_3$ conc., 180 gm MgO |

As in Example II, firing of the coatings was carried out in the strip furnace using a dry nitrogen atmosphere and a Bunsen burner flame curtain to protect the entrance end of the furnace. The samples were fired at 1500°F. (816°C.) for 1 to 1½ minutes. Again one-fourth inch was sheared from each edge of the samples to remove heavy coating.

Franklin resistivity measurements at 300 psi were taken at four positions on each sample both as cut and after a stress relief anneal at 1450°F. (788°C.) for 2 hours in a dry 95% nitrogen – 5% hydrogen atmosphere. The test results are given in Table VI below.

TABLE VI

RESISTIVITY TESTS OF SAMPLES OF EXAMPLE III

| Sample Number | Mole Ratio $Mg/PO_4$ | Ave. Franklin Resistivity (amps at 300 psi) Before SRA | After SRA | Change |
|---|---|---|---|---|
| 24 | .3 | .02 | .38 | .36 |
| 25 | .7 | .025 | .05 | .025 |
| 26 | .7 | .03 | .03 | .00 |
| 27 | 1.5 | .17 | .125 | −.045 |
| 28 | .5 | .01 | .41 | .40 |
| 29 | .5 | .01 | .66 | .65 |

Figure 2:
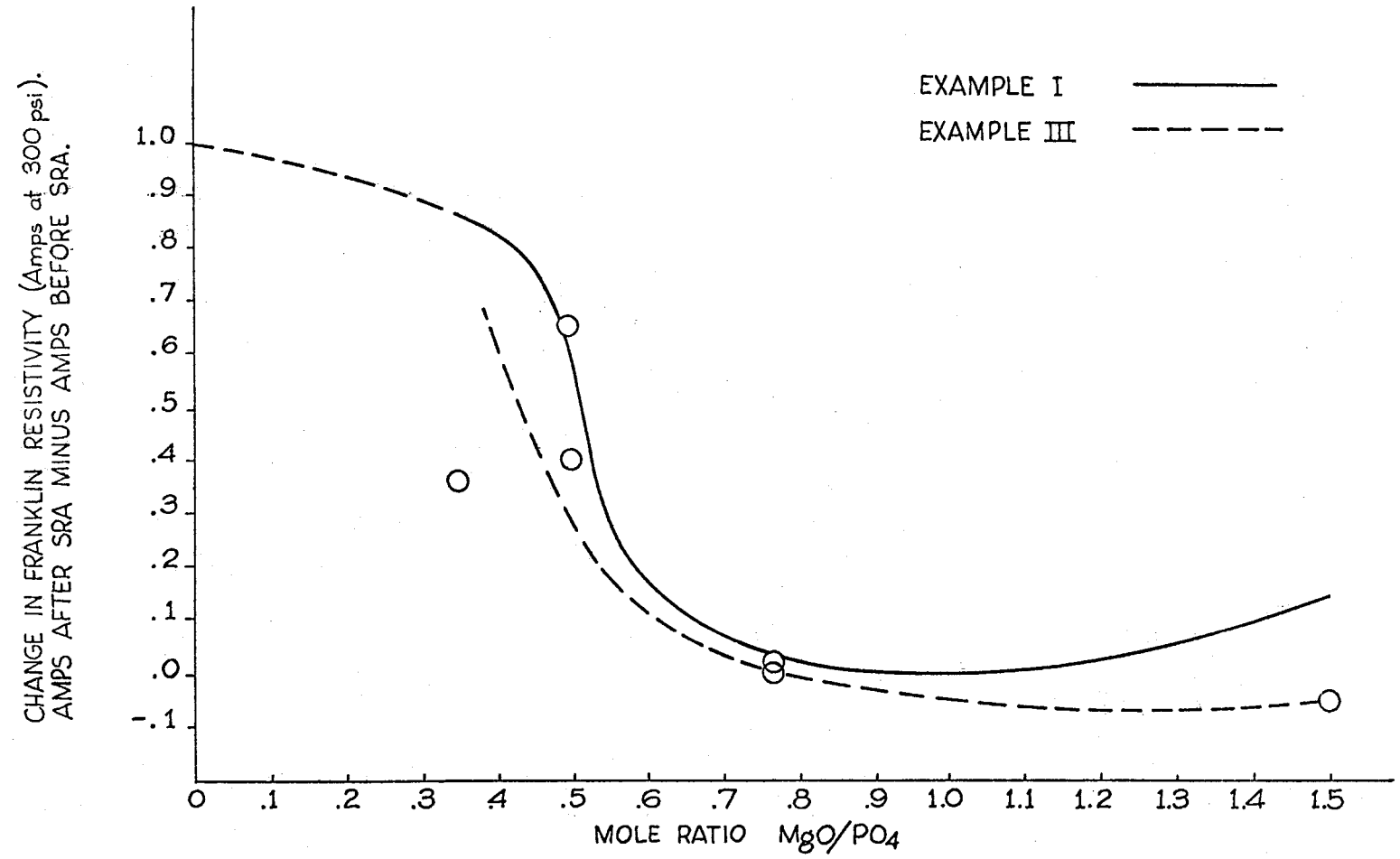

The results are graphically illustrated by the broken line in FIG. 2. Again the results of Example I appear as a solid line in FIG. 2 for purposes of comparison. It will again be noted that the coatings having a mole ratio of $Mg/PO_4$ within the ranges given above significantly prevented a loss of resistivity during the stress relief anneal.

The as cut resistivities of the samples of Example III, when compared to those of the samples of Example II, indicated that heavier coatings were produced in Example III. It is believed that these heavier coatings caused the shift of the curve of Example III to a position more nearly equal to the curve of Example I.

The Examples above clearly illustrate that the stability of the coatings during the stress relief anneal depends on the mole ratio $Mg/PO_4$ and that those coatings having a ratio within the above given ranges result in improved resistivity of the oriented silicon steel after a stress relief anneal both when they are applied to the bare steel and when they are applied over a mill glass base coating.

In general, the solution of the present invention should contain in weight percent no less than about 40% water; no less than about 2% $H_3PO_4$ in the solution; no more than about 45% $H_3PO_4$ in the solution; and no more than about 75% $H_3PO_4$ in the solution, calculated on a water-free basis.

A number of modifications may be made in the invention without departing from the spirit of it. For example, inert fillers, both soluble and insoluble, may be added to the solution to produce more body and thereby achieve thicker films and better resistivity. Exemplary inert fillers which may be used include colloidal $SiO_2$, mica, $Cr_2O_3$, $TiO_2$, $ZrO_2$, and the like. Addition of colloidal silica requires close pH control to prevent gelation of the colloid.

It will be understood by one skilled in the art that the final coating of the present invention may be produced by substituting magnesium phosphates for the phosphoric acid and magnesia. For example, an initial solution could be prepared from mono-basic magnesium phosphate and magnesia. Since the ratio $Mg/PO_4$ would be 0.5, magnesia should be added to increase the ratio. If di-basic magnesium phosphate is used, the ratio of 1.0 would be satisfactory without adding magnesia or phosphoric acid. However, if tri-basic magnesium phosphate is used, the ratio of 1.5 is undesirably high and additional phosphoric acid would be needed. In all cases mineral acid would be necessary to dissolve the solids and adjust the pH within the aforementioned ranges.

Furthermore, while the preferred form for introducing magnesium into the coating is magnesia powder, which becomes magnesium hydroxide when mixed with water, magnesium hydroxide may be added initially in place of all or part of the magnesia.

Modifications may be made in the invention without departing from the spirit of it.

The embodiments of the invention in which an exclusive property or privelege is claimed are defined as follows:

1. A process of providing an insulative coating on oriented silicon steel sheet-gauge stock for electrical uses comprising the steps of applying to said stock a coating composition comprising an aqueous solution having a $Mg/PO_4$ mole ratio of from about 0.6 to about 1.5, said solution consisting essentially of an aqueous solution of phosphoric acid, magnesia, and at least one substance chosen from the class consisting of sulfuric acid, nitric acid and magnesium salts thereof, said substance being present in an amount sufficient for said solution to have a pH within a range of from about 0.5 to about 3.0, drying said coated stock and subjecting said coated stock to a heat treatment to form said insulative coating.

2. The process claimed in claim 1 wherein said mole ratio is from about 0.7 to about 1.3 and said pH is from about 1 to about 2.

3. The process claimed in claim 1 wherein said heat treatment is conducted at a temperature of from about 800°F. (427°C.) to about 1600°F. (871°C.) for from about ½ minute to about 5 minutes in a dry, non-oxidizing atmosphere.

4. The process claimed in claim 1 wherein said silicon steel has a mill glass thereon, said solution being applied over said mill glass and said insulative coating being formed on said mill glass.

5. The process claimed in claim 4 wherein said heat treatment is conducted at a temperature of from about 1200°F. (649°C.) to about 1600°F. (871°C.) for from about ½ minute to about 5 minutes in air.

6. A process of providing an insulative coating on oriented silicon sheet-gauge stock for electrical uses comprising the steps of applying to said stock a coating composition comprising an aqueous solution having an $Mg/PO_4$ mole ratio of from about 0.6 to about 1.5, said solution consisting essentially of an aqueous solution of compounds chosen from the class consisting of monobasic magnesium phosphate, di-basic magnesium phosphate, tri-basic magnesium phosphate, magnesia, and phosphoric acid, plus at least one substance chosen from the class consisting of sulfuric acid, nitric acid and magnesium salts thereof, said substance being present in an amount sufficient for said solution to have a pH within a range of from about 0.5 to about 3.0, drying said coated stock and subjecting said coated stock to a heat treatment to form said insulative coating.

7. The process claimed in claim 6 wherein said mole ratio is from about 0.7 to about 1.3 and said pH is from about 1 to about 2.

8. The process claimed in claim 6 wherein said heat treatment is conducted at a temperature of from about 800°F. (427°C.) to about 1600°F. (871°C.) for from about ½ minute to about 5 minutes in a dry, non-oxidizing atmosphere.

9. Silicon steel having an insulative coating made by the process claimed in claim 6.

10. Cube-on-edge oriented silicon steel having a mill glass and an additional insulative coating made by the process of claim 6.

11. The process claimed in claim 6 wherein said silicon steel has a mill glass thereon, said solution being applied over said mill glass and said insulative coating being formed on said mill glass.

12. The process claimed in claim 11 wherein said heat treatment is conducted at a temperature of from about 1200°F. (649°C.) to about 1600°F. (871°C.) for from about ½ minute to about 5 minutes in air.

* * * * *